US007748783B2

(12) United States Patent
Kinoshita et al.

(10) Patent No.: US 7,748,783 B2
(45) Date of Patent: Jul. 6, 2010

(54) BACKREST FOR CHAIR

(75) Inventors: Yojiro Kinoshita, Osaka (JP); Kenji Teshima, Osaka (JP)

(73) Assignee: Kokuyo Co., Ltd. (JP)

( * ) Notice: Subject to any disclaimer, the term of this patent is extended or adjusted under 35 U.S.C. 154(b) by 53 days.

(21) Appl. No.: 12/177,926

(22) Filed: Jul. 23, 2008

(65) Prior Publication Data

US 2008/0284230 A1 Nov. 20, 2008

Related U.S. Application Data

(63) Continuation of application No. 10/812,358, filed on Mar. 30, 2004, now abandoned.

(30) Foreign Application Priority Data

Nov. 13, 2003 (JP) ..... P2003-384168

(51) Int. Cl.
*A47C 3/00* (2006.01)
*A47C 7/02* (2006.01)

(52) U.S. Cl. ..... 297/284.4; 297/284.7; 297/284.1; 297/452.29

(58) Field of Classification Search ..... 297/284.1, 297/284.4, 284.7, 452.29
See application file for complete search history.

(56) References Cited

U.S. PATENT DOCUMENTS 3,973,797 A * 8/1976 Obermeier et al. ..... 297/284.4
4,153,293 A 5/1979 Sheldon
4,156,544 A * 5/1979 Swenson et al. ..... 297/284.4
4,367,897 A * 1/1983 Cousins ..... 297/284.3
4,452,485 A 6/1984 Schuster
4,679,848 A 7/1987 Spierings et al.
4,811,986 A 3/1989 Hattori et al.
4,880,271 A 11/1989 Graves
5,215,350 A 6/1993 Kato
5,286,087 A 2/1994 Elton
5,385,388 A 1/1995 Faiks et al.
5,403,067 A 4/1995 Rajaratnam et al.
5,556,169 A * 9/1996 Parrish et al. ..... 297/452.28
5,716,098 A * 2/1998 Lance ..... 297/284.4
5,791,733 A 8/1998 van Hekken et al.
5,797,652 A 8/1998 Darbyshire
5,806,910 A 9/1998 Derees et al.
5,860,700 A 1/1999 Lance
6,030,041 A 2/2000 Hsiao
6,220,661 B1 4/2001 Peterson (Continued)

FOREIGN PATENT DOCUMENTS

EP 0300957 1/1989

(Continued)

*Primary Examiner*—David Dunn
*Assistant Examiner*—Erika Garrett
(74) *Attorney, Agent, or Firm*—Banner & Witcoff, Ltd.

(57) ABSTRACT

In order to secure a shape retaining property of a support face of a backrest 1 of a chair, the backrest 1 for chairs comprises frame elements 21 and 22 arranged in pairs at right and left sides, a flexible support member 3 that bridges the frame elements 21 and 22 to support a load of a body of a seated person and an adjust mechanism that can change a bent degree of the support member 3 in multiple states and that can maintain the state against the load of the seated person.

20 Claims, 20 Drawing Sheets

U.S. PATENT DOCUMENTS 6,254,186 B1 7/2001 Falzon
6,260,921 B1 7/2001 Chu et al.
6,338,530 B1 1/2002 Gowing
6,349,992 B1 * 2/2002 Knoblock et al. ..... 297/300.2
6,354,662 B1 3/2002 Su
6,378,942 B1 4/2002 Chu
6,520,580 B1 2/2003 Hong
6,575,530 B1 6/2003 Fischer et al.
6,588,836 B1 7/2003 Lo
6,688,687 B2 2/2004 Chu
6,695,403 B1 2/2004 Su
6,799,803 B1 5/2004 Lee et al.
6,755,467 B1 6/2004 Chu
6,805,405 B2 10/2004 Koo
6,811,215 B2 * 11/2004 Horiki et al. ..... 297/228.1
6,820,933 B2 11/2004 Fereira Da Silva
6,848,744 B1 2/2005 Raftery et al.

FOREIGN PATENT DOCUMENTS

| | | |
|---|---|---|
| GB | 153138 | 11/1920 |
| GB | 360516 | 11/1931 |
| GB | 1536132 | 12/1978 |
| JP | 10-192085 | 7/1988 |
| JP | H3-98650 | 9/1991 |
| JP | 2000-51001 | 2/2000 |
| WO | 0232263 | 4/2002 |

* cited by examiner

BACKREST FOR CHAIR

CROSS REFERENCE TO RELATED APPLICATIONS

This application is a continuation of U.S. Ser. No. 10/812,358, filed Mar. 30, 2004, which claims priority from Japanese application P2003-384168 filed Nov. 13, 2003. The entire contents of these applications are incorporated herein by reference.

FIELD OF THE INVENTION

This invention relates to a backrest for a chair.

BACKGROUND OF THE INVENTION

It is well-known that a backrest for a chair is so arranged that a spring fabric that makes an elastic deformation to expand and contract bridges between frames separately arranged at right and left sides as shown in the Japan Laid-Open Disclosure Public Patent Bulletin (Patent Laid-Open Number 10-192085). In accordance with the backrest, the spring fabric stretches to support a body of a seated person when a load of the seated person applies to the backrest. A feeling to sit on the chair can be adjusted to a certain degree by changing an initial tensile force of the spring fabric.

However, in a state that a load of the seated person is not applied, more specifically, in a state that no person sits on the chair, the spring fabric restores itself to a state that the spring fabric is strained between frames due to an elastic force. In other words, the spring fabric does not contribute to retaining a shape of a support face that supports the body of the seated person three dimensionally. This is inconvenient from a view point of appearance design of the chair.

BRIEF SUMMARY OF THE INVENTION

In order to solve the above problems the present claimed invention arranges a backrest for chair that comprises frame elements arranged in pairs at right and left sides, a flexible support member that bridges the frame elements to support a load of a body of a seated person and an adjust mechanism that can change a bent degree of the support member in multiple states and that can maintain the state against the load of the seated person.

In accordance with the arrangement, it is possible to keep a preferable bent shape of the support member regardless of a size of a seated person. As a result of this, it is possible to keep supporting the body of the seated person in a preferable position. In addition to this, the support member is not necessarily be a spring. It is possible to keep the bent shape even though the seated person is not seated on the chair. As a result of this, a shape retaining property of a support face that supports the body of the seated person can be secured and it is also advantageous for a design of the chair.

As one form of the adjust mechanism represented is that the bent degree of the support member is varied by selectively fastening one end side of the support member to one of multiple different portions of the frame element locating at a corresponding side. More specifically, in the adjust mechanism of this arrangement, a distance between one end side of the support member and the other end side thereof varies depending on which portion of the frame element is tied up by one end side of the support member so that a bent amount of the support member increases or decreases.

If the adjust mechanism is an engaging structure between a pin mounted on either one of the support member and the frame element and at least one engaging hole formed on the other and an engaging portion where the pin makes an engagement with the engaging hole can be varied, it is possible to change the bent amount of the support member without requiring any complicated mechanism.

If the engaging hole has multiple engaging edge portions that make an engagement with the pin so as to tie up the pin when a load of the seated person is applied to the support member and the engaging edge portions are communicating each other and the pin can be changed from a state of engaging a engaging edge portion to a state of engaging another engaging edge portion by operating the pin to move along the engaging hole, it is possible to increase or decrease the bent amount of the support member with a simple operation.

As another arrangement of the adjust mechanism represented is an arrangement that changes a bent degree of the support member by changing a length of a portion that makes a bent transformation when the load of the seated person is applied to the support member.

More concretely, one of multiple different portions at one end side of the support member can be selectively fastened to the frame element locating at a corresponding side. In other words, depending on which portion of the support element is fastened by the frame element a distance between the portion of the support member and the other end side of the support member varies so that a bent amount of the support member increases or decreases. Alternatively, the adjust mechanism may act on at least one end side of the support member wound inward through the frame element so as to change a length of a portion of the support member that bridges front faces of the right and left frame elements.

In addition, if the adjust mechanism has an operating portion to operate the support member in order to change a bent degree of the support member and the operating portion is exposed to a side portion of a back face, it is possible for the seated person to operate the operating portion with keeping a seated state and to increase or decrease the bent amount of the support member so as to transform the support face that supports the body of the seated person to a desired shape.

If the support member is arranged at a height generally corresponding to a lumbar portion of the seated person, the support member supports the lumbar portion of the seated person. And it is possible to change the bent amount of the support member at the discretion of the seated person and to support the lumbar portion in a desired state.

Further, if a generally bag-shaped upholstery member is used to cover the frame elements and the support member, the frame elements, the support member and the upholstery member form a preferable support face so as to support the body of the seated person.

In accordance with the above-described present claimed invention, a shape retaining property of the support face can be secured. In addition, since the bent degree of the support member is kept regardless of the size of the load of the seated person, it is possible to keep supporting the body of the seated person in a preferable position.

DETAILED DESCRIPTION OF THE INVENTION

Figure 1:
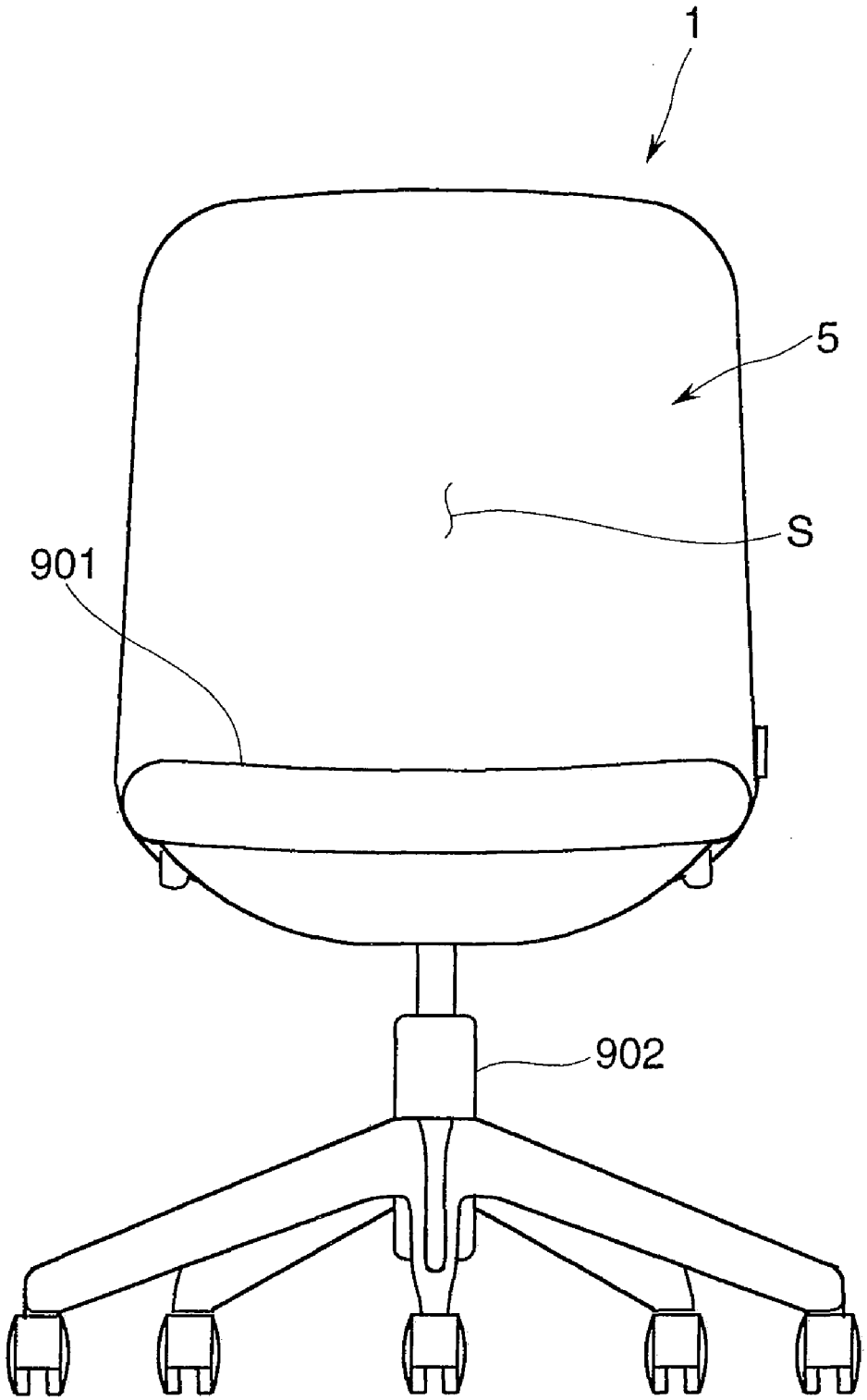
FIG. 1 is a front view showing a chair comprising a backrest in accordance with one embodiment of the present claimed invention.
Figure 2:
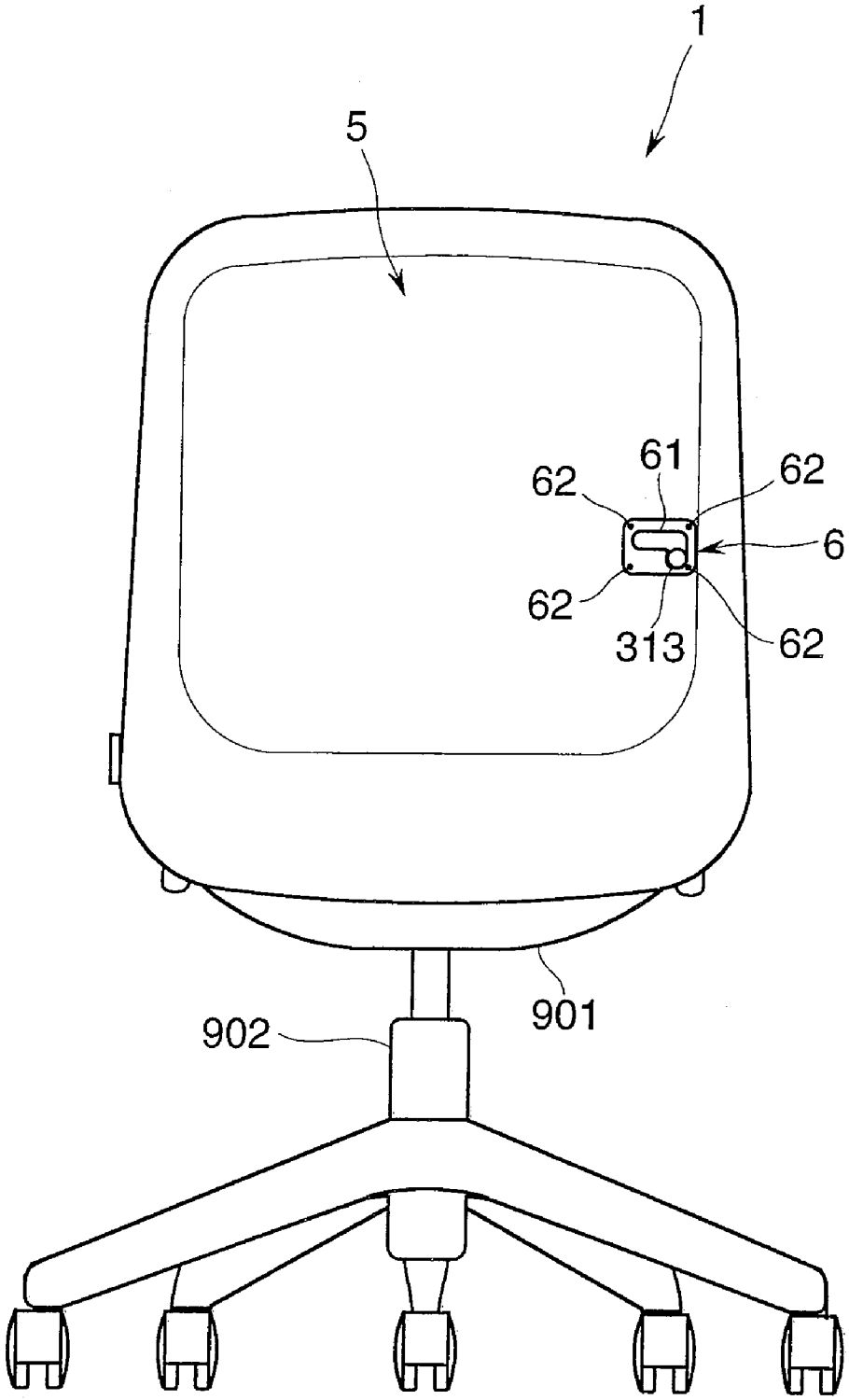
FIG. 2 is a back view of the chair.
Figure 3:
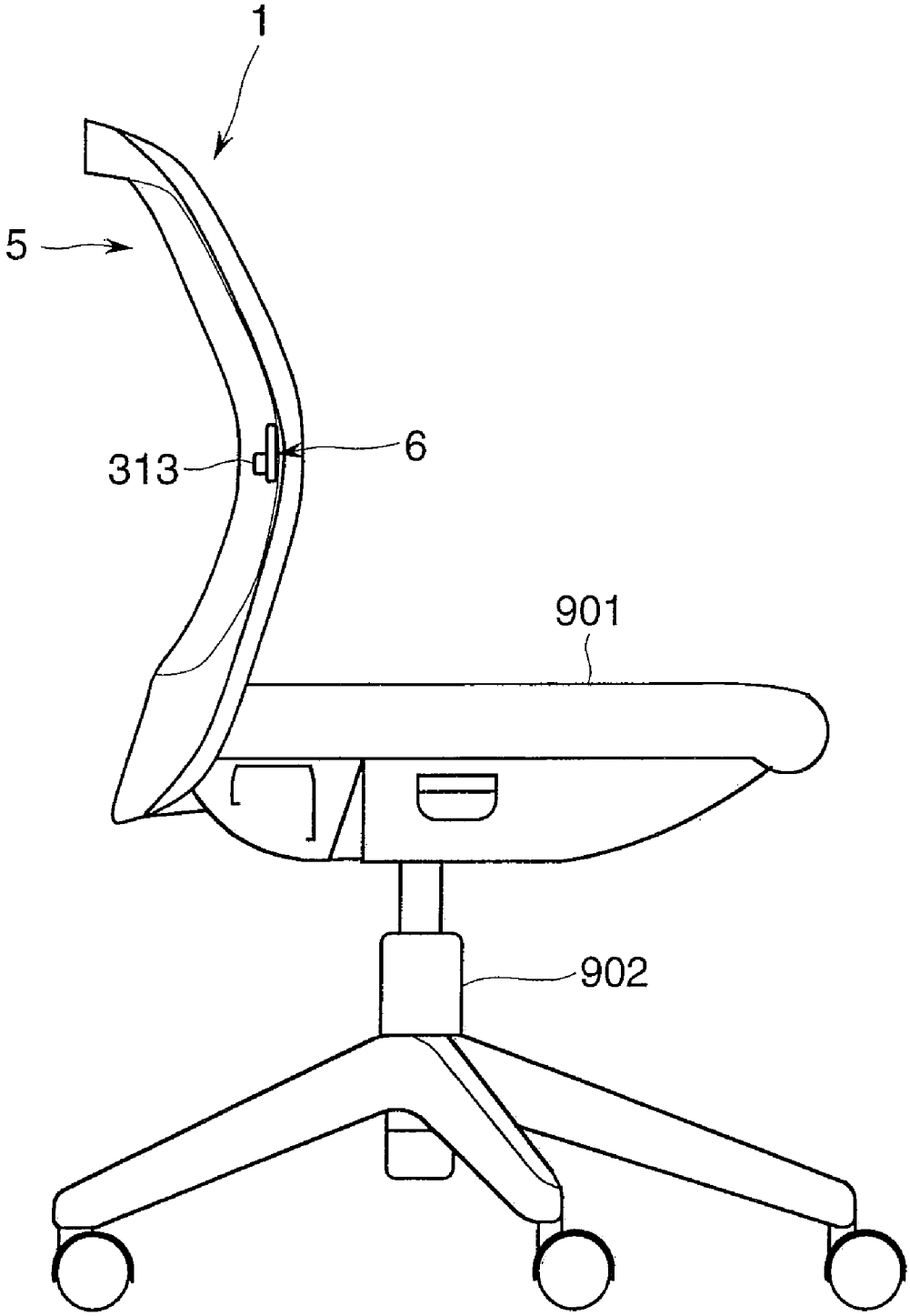
FIG. 3 is a left side view of the chair.

One embodiment of the invention will be explained with reference to drawings. A chair shown in FIG. 1 and FIG. 3 is a chair to which a backrest in accordance with the embodiment of the present claimed invention is applied and comprises a seat 901 on which a hip of a seated person is placed, a backrest 1 that supports a back and a lumbar of the seated person from rearward and a leg support post 902 that supports the seat 901 and the backrest 1.

The backrest 1 of this embodiment mainly comprises a frame 2 that forms an outline of the backrest 1, a support member 3 supported by the frame 2, a shock absorbing member 4 arranged to overlap a front face of the support member 3 and an upholstery member 5 that covers the frame 2, the support member 3 and the shock absorbing member 4 so as to form a support face S in a front face side to support a body of the seated person.

Figure 4:
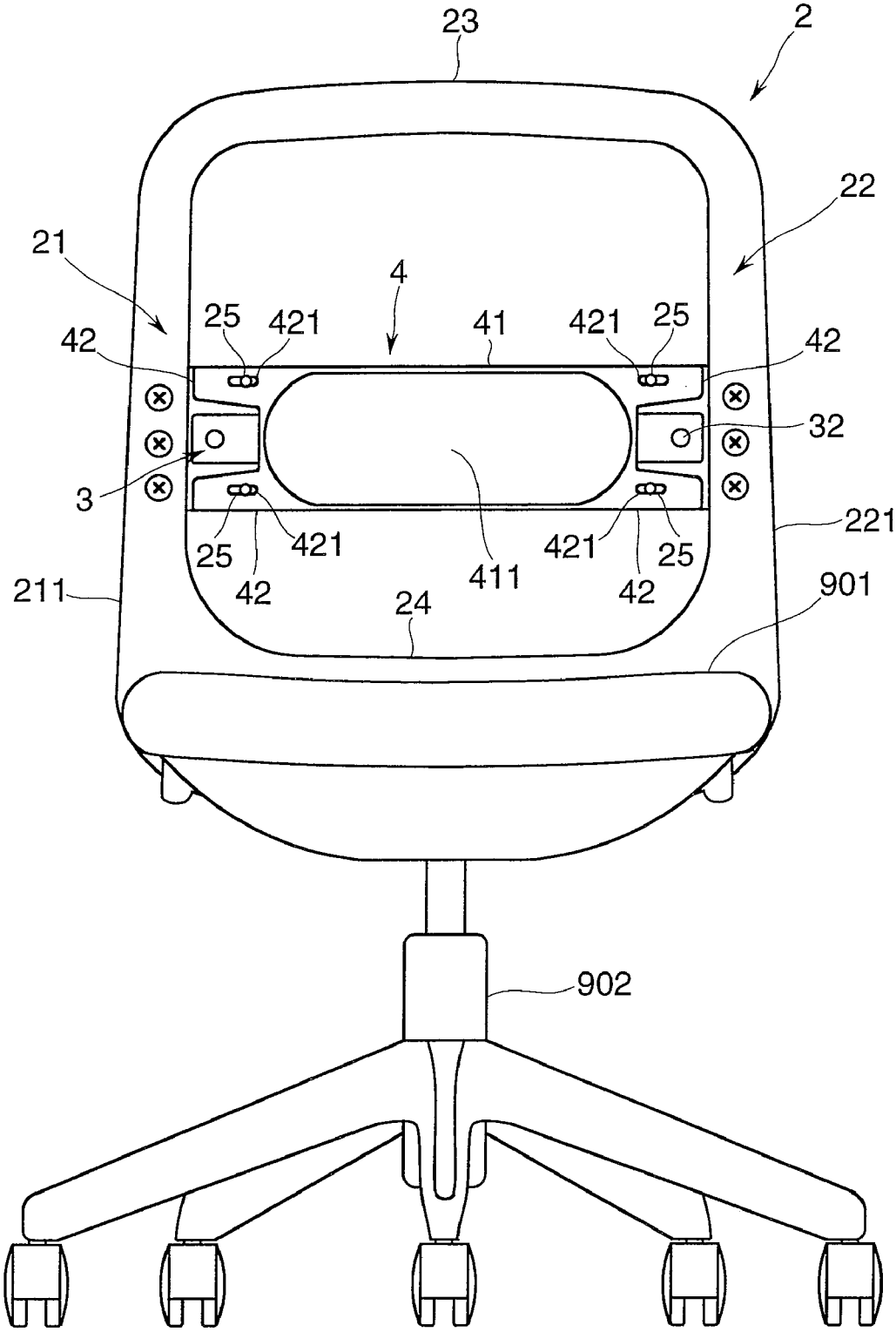
FIG. 4 is a front view showing a frame element and a support member.
Figure 5:
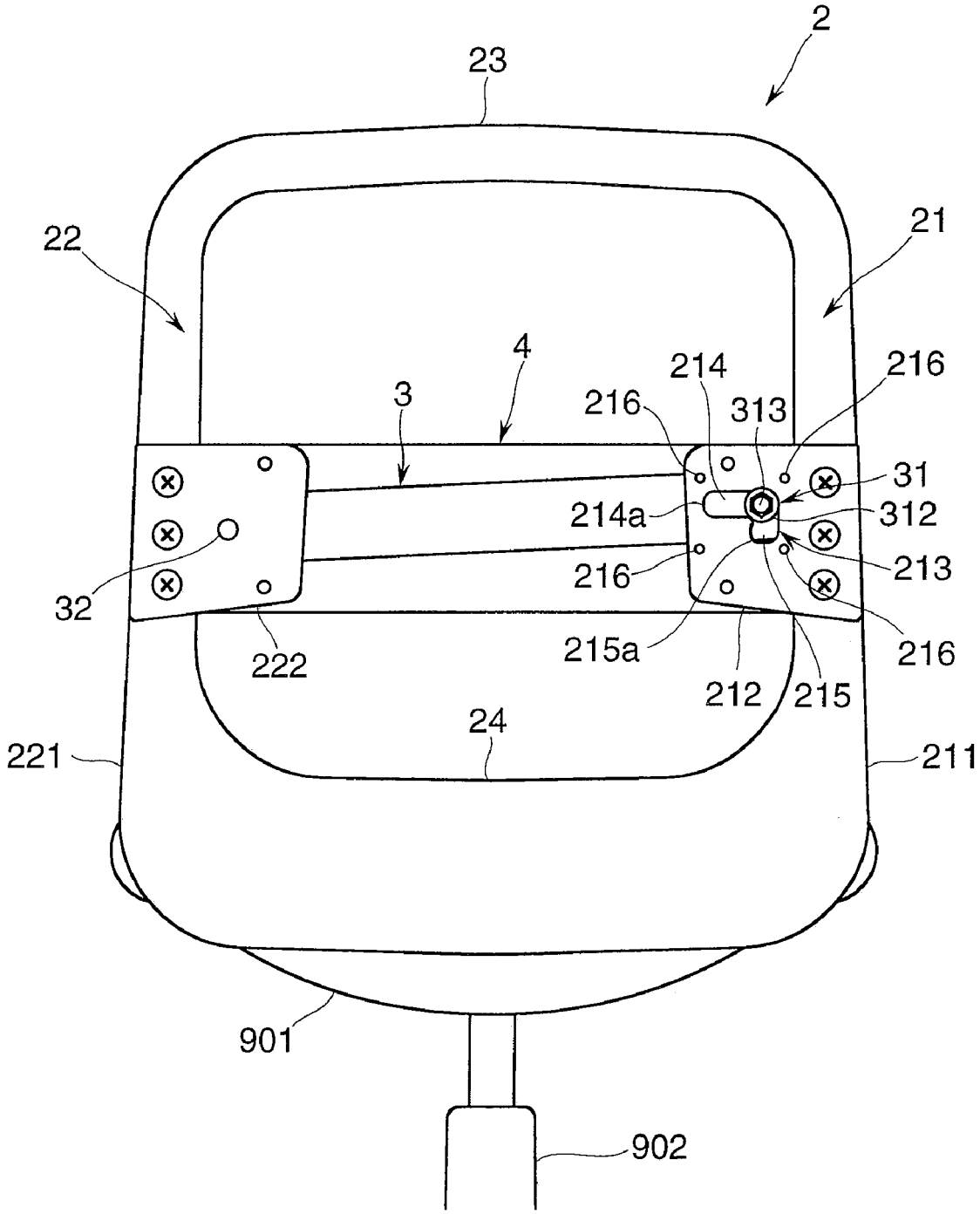
FIG. 5 is a back view showing the frame element and the support member.
Figure 8:
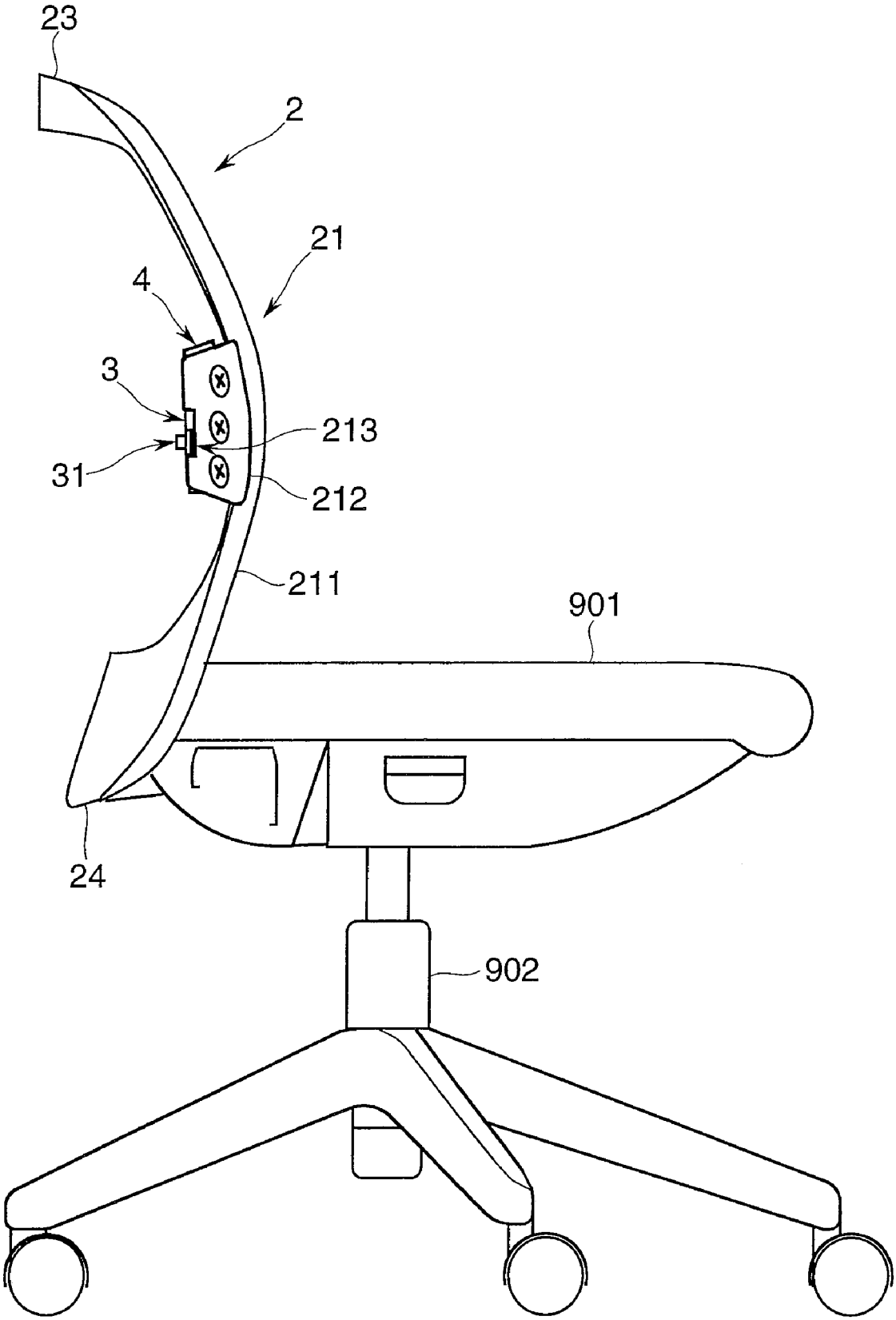
FIG. 8 is a left side view of the above.

FIG. 4 and FIG. 8 show the backrest 1 in a state that the upholstery member 5 is removed. The frame 2 comprises an upper frame 23, a lower frame 24, a left side frame 211 and a right side frame 221, each of which is made of a hollow rigid member in a generally frame shape viewed from the front. Each of the upper frame 23, the lower frame 24, the left side frame 211 and the right side frame 221 is a plate shaped body whose cross directional thickness is relatively thin. Each of the upper frame 23 and the lower frame 24 is curved at a middle portion slightly backward and each of the right side frame 221 and the left side frame 211 is curved at a middle portion thereof slightly frontward. Each of the right side frame 221 and the left side frame 211 is so curved to thrust frontward the most at a position generally corresponding to a height of the lumbar of the seated person. Plates 212, 222 extending to approach each other are fixed near the position.

In this embodiment, the left side frame 211 and the left side plate 212 fixed to the left side frame 211 correspond to the left side frame element 21 and the right side frame 221 and the right side plate 222 fixed to the right side frame 221 correspond to the right side frame element 22. The frame elements 21, 22 play a role of supporting the support member 3 so that the support member 3 can receive (at least a part of) a load of the seated person appropriately. A concrete arrangement of the frame elements 21, 22 is not limited to the embodiment, and it may be so arranged, for example, a plate-shaped frame is bent or curved so that both end portions of the frame project forward compared with a middle portion of the frame and both end portions serve as the frame element. Then the support member 3 and the shock absorbing member 4 bridge the frame elements 21 and 22. More concretely, both end portions of the support member 3 are arranged on each of front faces of the right and left side plates 222, 212 and the shock absorbing member 4 is arranged on a front face of the support member 3. The support member 3 and the shock absorbing member 4 are arranged at a position generally corresponding to the lumbar portion of the seated person and play a role of supporting a load of the seated person, especially a load received from the lumbar portion of the seated person.

The support member 3 is a strip-shaped member having elasticity and made of, for example, a resin material. At one end side of the support member 3 mounted is a pin 31 projecting rearward. In this embodiment, the pin 31 is mounted on the left side end portion of the support member 3. An engaging hole 213 that makes an engagement with the pin 31 is arranged on the frame element 21 of the corresponding side. In this embodiment, the engaging hole 213 is formed on the plate 212 of the left side frame element 21. The other end side of the support member 3 is mounted on the frame element 22 of the corresponding side through a rotational axis 32. More specifically, a right side end portion of the support member 3 is mounted on the plate 222 of the right side frame element 22 from a front face through the rotational axis 32. The support member 3 can make an oscillating movement up and down around the rotational axis 32 arranged on the right side end portion of the support member 3.

Figure 9:
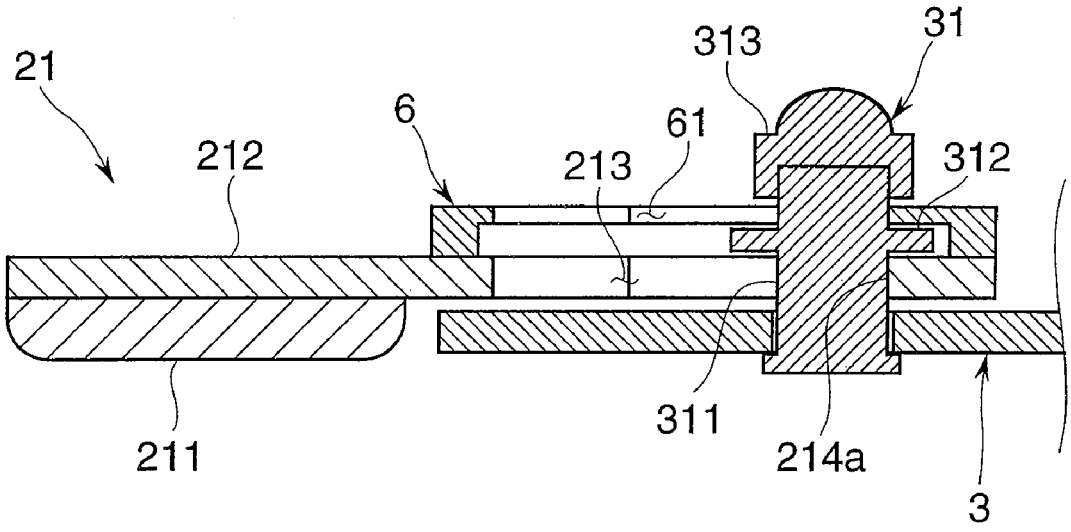
FIG. 9 is a horizontal sectional view of a principal part showing an engaging structure of an engaging hole and a pin.
Figure 10:
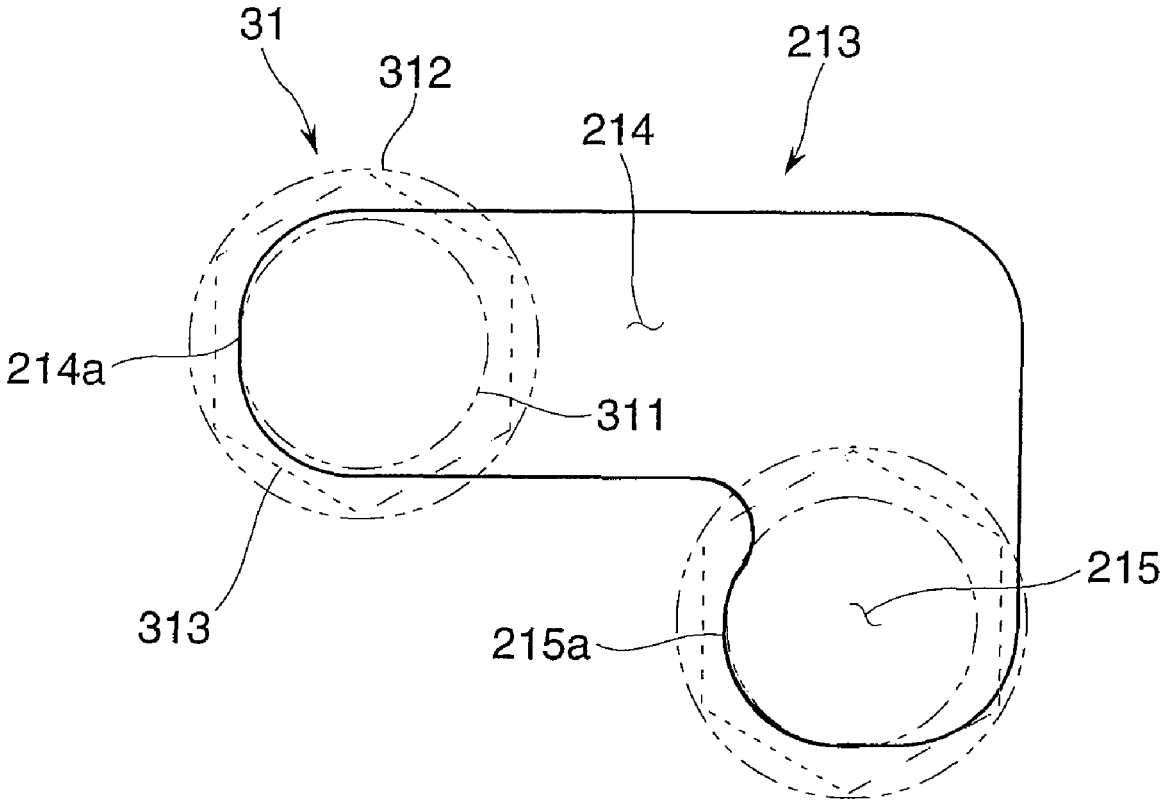
FIG. 10 is a back view of the principal part showing the engaging structure of the engaging hole and the pin.

Next, an engaging structure of the pin 31 and the engaging hole 213 will be described. As shown in FIG. 9, the pin 31 is, for example, a metal member that makes an engagement with the engaging hole 213 formed on the plate 212 by passing therethrough from frontward. The ping 31 has a shaft portion 311 that is inserted into the engaging hole 213 and that makes an engaging with a rim of the engaging hole 213, a brim portion 312 that extends toward a radial direction at a rear end or the shaft portion 311 and a grip portion 313 that projects rearward from a rear face of the brim portion 312. When the pin 31 engages the engaging hole 213, the brim portion 312 is arranged at a rear face side of the plate 212 and engages the rear face of the plate 212 so as to prevent the pin 31 from getting out of the engaging hole 213 toward a front. As shown in FIG. 10, the engaging hole 213 has a long hole portion 214 arranged at generally the same height as that of the rotational axis 32 and extending toward a width direction and a round hole portion 215 arranged to integrally form a through hole on an underside of the long hole portion 214. The round hole portion 215 may be arranged on an upper side of the long hole portion 214. When a load of the seated person is applied to the support member 3 from a frontward, each of an inner side edge **214*a* of the long hole portion 214 and an inner side edge 214*a* of the round hole portion 215 makes an engagement with the shaft portion 311 of the pin 31 so as to tie up the pin 31 and further the support member 3 with the plate 212**.

The inner side edge **214*a* of the long hole portion 214 locates at a position sufficiently an inner side compared with a position of the inner side edge 215*a* of the round hole portion 215. As a result of this, a bent degree of the support member 3 can be varied by selectively fastening the pin 31 to one of the inner side edge 214***a* of the long hole portion 214 and the inner side edge 215*a* of the round hole portion 215. More specifically, when the pin 31 makes an engagement with the inner side edge 214*a* of the long hole portion 214, a distance between the pin 31 locating at one side of the support member 3 and the rotational axis 32 locating at the other side of the support member 3 is relatively shortened. As a result, the middle portion of the support member 3 is in a rearward bent state by a relatively big amount. When the pin 31 makes an engagement with the inner side edge 215*a* of the round hole portion 215, a distance between the pin 31 locating at one side of the support member 3 and the rotational axis 32 locating at the other side of the support member 3 is relatively lengthened. As a result, the middle portion of the support member 3 is in a rearward bent state by a relatively small amount. In this state one side of the support member 3 is made generally in the same height as the other side of the support member 3.

Figure 6:
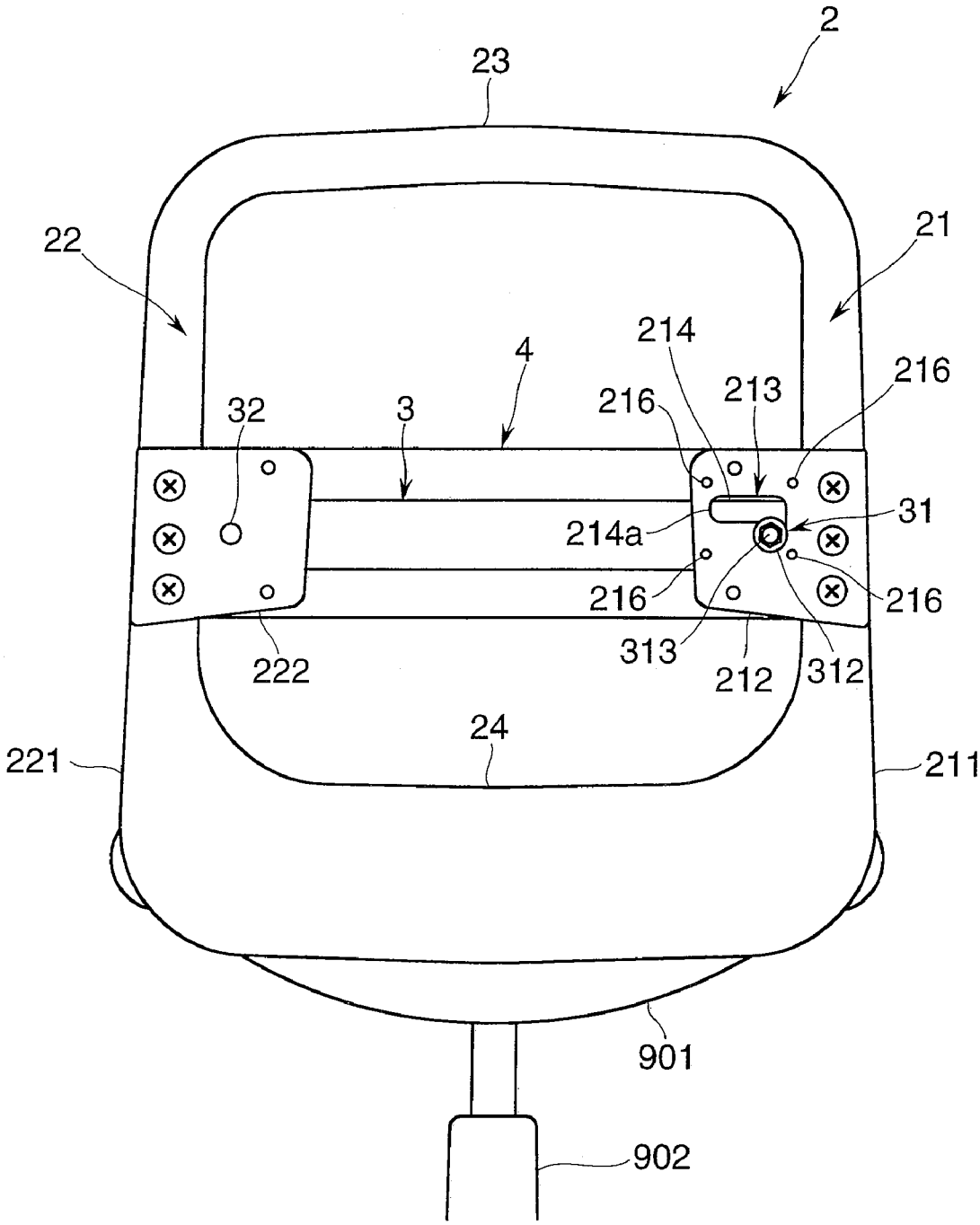
FIG. 6 is a back view of a principal part of the frame element and the support member.

In order to switch a bent amount of the support member 3, operate the pin 31 locating in the long hole portion 214 to move in the round hole portion 215 as shown in FIG. 6 or operate the pin 31 locating in the round hole portion 215 to move in the long hole portion 214 as shown in FIG. 6. This operation can be conducted by sliding the pin 31 along the engaging hole 213. A boundary area between the long hole portion 214 and the round hole portion 215 of the engaging hole 213 is in generally the same width as the width of the shaft portion 311 of the pin 31 so that an operator who switches the bent amount can feel an appropriate click feeling in switching the bent amount.

The shock absorbing member 4 has, as shown in FIG. 4, a base portion 41 that is in a generally square shape whose front face side a cushion body 411 is laid in and a mount portion 42 that extends outward from four corners of the base portion 41 and functions to give the seated person a soft comfortable feeling to sit on. The shock absorbing member 4 is arranged to bridge the frame elements 21 and 22 with the mount portion 42 supported by the right and left plates 212 and 222. A long hole 421 extending toward a direction of a width thereof is formed on the mount portion 42 of the shock absorbing member 4. A locking member 25 (like a bolt) that is mounted on front faces of the right and left plates 212 and 222 passes through each long hole 421. A radius of a front portion of the locking member 25 is enlarged just like a bolt head so that the mount portion 42 is prevented from detaching forward. The mount portion 42 is movable along a direction of a width (as far as the locking member 25 can move its position relatively along the long hole). Then the shock absorbing member 4 itself elastically transforms to bend rearward due to the load received from the body of the seated person. However, as mentioned before, since the support member 3 exists just behind the shock absorbing member 4, a range of transformation to bent rearward of the shock absorbing member 4 is limited to a range of bent degree of the support member 3.

Figure 7:
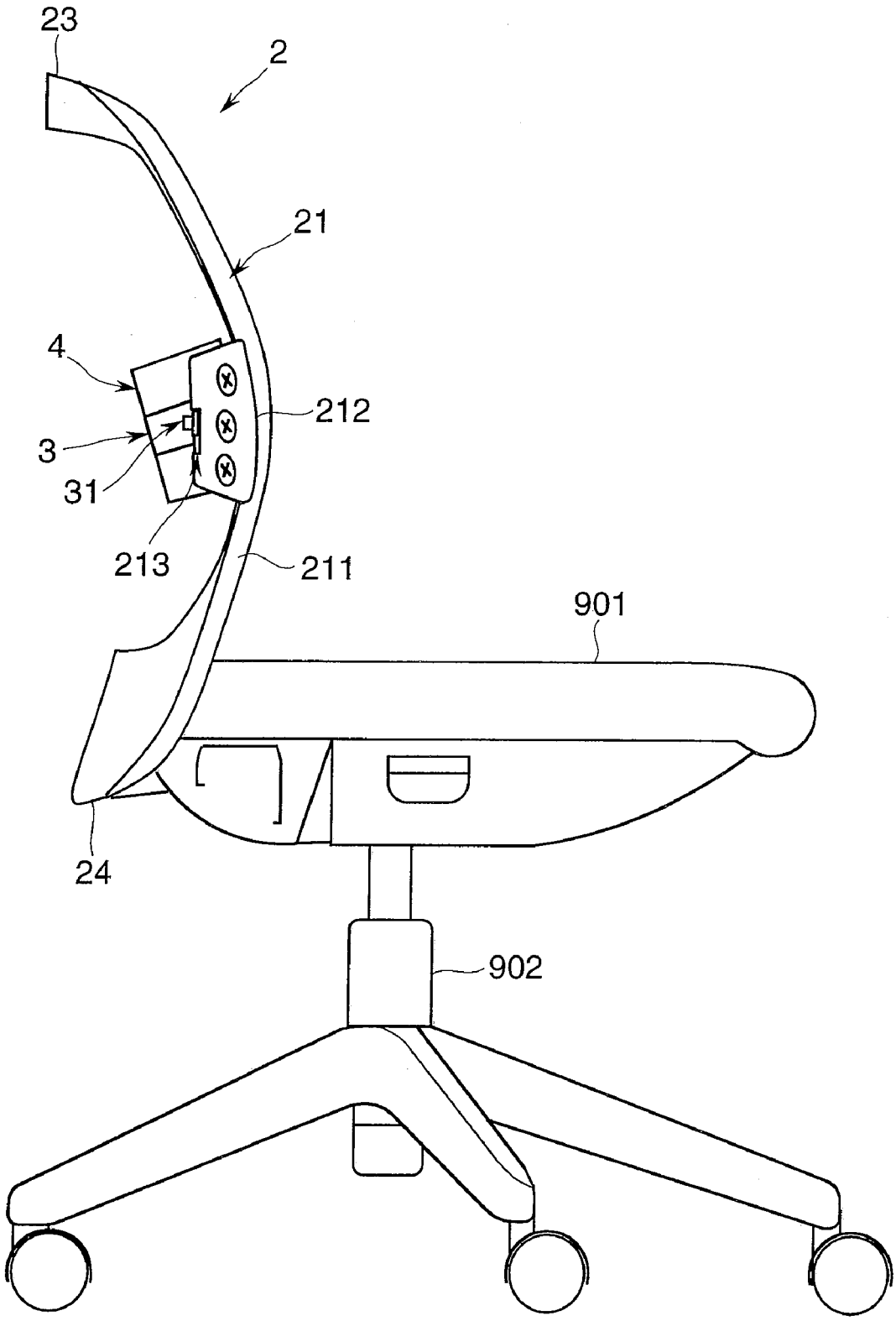
FIG. 7 is a left side view showing the frame element and the support member.

A generally bag-shaped upholstery member 5 covers the frame 2, the support member 3 and the shock absorbing member 4 so as to complete the backrest 1 of this embodiment. The upholstery member 5 is set to a size exactly fitting the frame 2. The upholstery member 5 is preferably made of an elastically expandable material. The upholstery member 5 set up on the front face of the backrest 1 forms the support face S supported by the frame 2, the support member 3 and the shock absorbing member 4 from rearward and supports the body of the seated person. The upholstery member 5 forms the support face S of different shapes in accordance with a bent amount of the shock absorbing member 4, namely, in accordance with a bent amount of the support member 3. In case the pin 31 arranged on one end side of the support member 3 locates in the long hole portion 214 of the engaging hole 213 formed on the plate 212 locating in the corresponding side, middle portions of the support member 3 and the shock absorbing member 4 bend relatively widely so as to be concaved rearward due to the load of the seated person as shown in FIG. 7 and the support face S is in a shape to wrap around the back and the lumbar of the seated person. After the pin 31 engages the inner side edge 214*a* of the long hole portion 214, the support member 3 and the shock absorbing member 4 do not transform to bend any more regardless of the size of the load of the seated person. More specifically, the support face S is kept in a shape of wrapping around the back and the lumbar of the seated person. In case the pin 31 locates in the round hole portion 215 of the engaging hole 213, middle portions of the support member 3 and the shock absorbing member 4 do not bend so much in spite of the load of the seated person as shown in FIG. 8. As a result, the support face S is so formed that a portion corresponding to the lumbar of the seated person thrusts forward depending on a bent shape of the left side frame 211 and the right side frame 221. In this case also, after the pin 31 engages the inner side edge 215*a* of the round hole portion 215, the support member 3 and the shock absorbing member 4 do not transform to bend any more regardless of the size of the load of the seated person. More specifically, the support face S is kept in a shape that the portion corresponding to the lumbar portion of the seated person thrusts forward. Further, once a shape of the support face S is formed, the shape is kept after the seated person stands up from the seat (unless the pin 31 is operated).

Generally speaking, the adjust mechanism is arranged by the engaging structure comprising the pin 31 arranged on the support member 3 and the engaging hole 213 formed on the plate 212 wherein the bent amount of the support member 3 is varied in multiple different states. The adjust mechanism makes it possible to select one of the two different states wherein the bent amount of the support member 3 differs by selectively fastening the pin 31 to one of the multiple different portions on the plate 212, in other words, by selectively fastening the pin 31 to the inner side edge 214*a* of the long hole portion 214 or the inner side edge 215*a* of the round hole portion 215.

It is preferable that the pin 31 operated to vary the bent amount of the support member 3 is exposed out of the side portion (in this embodiment, left side portion) of the back face of the backrest 1 for chair. In this embodiment, an area of a back face side of the upholstery member 5 is open so as to expose the pin 31 and the engaging hole 213. Then after the upholstery member 5 covers the flame 2, a cap 6 to cover the area is mounted. The cap 6 is made of, for example, resin in which a perforated window opening 61 is arranged and fixed to the rear face of, for example, the left side plate 212 with a bolt 62 or the like. It is necessary that the window opening 61 is so formed not to prevent the pin 31 from moving along the engaging hole 213. In this embodiment a shape of the window opening 61 is so formed to be similar to that of the engaging hole 213.

In accordance with this embodiment, since the backrest 1 for chair comprises a pair of the frame elements 21, 22 arranged in pairs at the right and left sides, the flexible support member 3 that bridges the frame elements 21, 22 to support the load of the body of the seated person and the adjust mechanism that can vary a bent degree of the support member 3 in multiple states and that can maintain the state against the load of the seated person, it is possible to secure a shape retaining property of the shape of the support face S that supports the body of the seated person. In addition, it is possible to keep supporting the body of the seated person in a preferable position.

Since the adjust mechanism is arranged at least one of the right and left sides and the bent degree of the support member 3 is varied by selectively fastening one end side of the support member 3 to one of multiple different portions of the frame element 21 locating at a corresponding side, it is possible to increase or decrease the bent amount of the support member 3 by changing the distance between one end side (especially, the pin 31) of the support member 3 and the other end side (especially, the rotational axis 32).

Since the adjust mechanism is an engaging structure between the pin 31 mounted on the support member 3 and at least one engaging hole formed on the frame element 21 and an engaging portion where the pin 31 makes an engagement with the engaging hole can be varied, it is possible to change the bent amount of the support member 3 without requiring any complicated mechanism.

Since the engaging hole 213 has multiple engaging edge portions, more specifically, the inner side edge 214*a* of the long hole portion 214 and the inner side edge 215*a* of the round hole portion 215 that make an engagement with the pin 31 so as to tie up the pin 31 when the load of the seated person is applied to the support member 3 and the engaging edge portions are communicating each other and the pin 31 can be changed from a state of engaging an engaging edge portion to a state of engaging another engaging edge portion by operating the pin 31 to move along the engaging hole 213, it is possible to increase or decrease the bend amount of the support member 3 with a simple operation.

In addition, the adjust mechanism has the grip 313 of the pin 31 as the operating portion to operate the support member 3 to change the bent degree of the support member 3 and the grip 313 is exposed in the side portion of the back face, it is possible for the seated person to operate the grip 313 with keeping a seated state and to increase or decrease the bent amount of the support member 3 so as to transform the support face S that supports the body of the seated person to a desired shape.

Since the support member 3 is arranged at a height generally corresponding to the lumbar portion, the support member 3 can support the lumbar portion of the seated person. Then it is possible to support the lumbar portion in a desired state by changing the bent amount of the support member 3 at the discretion of the seated person.

Further, the generally bag-shaped upholstery member 5 covers the frame element 21, 22 and the support member 3 so that the frame elements 21, 22, the support member 3 and the shock absorbing member 5 form the preferable support face S to support the body of the seated person.

The present claimed invention is not limited to the above-described embodiment. Especially, the support member 3 and the adjust mechanism may be variously modified in addition to the above embodiment. Next, a concrete modified form of the support member 3 and the adjust mechanism will be described. The frame 2 and the upholstery member 5 may be the same as that of the above-embodiment, then explanation and drawings will be omitted in each of the modified forms.

Figure 11:
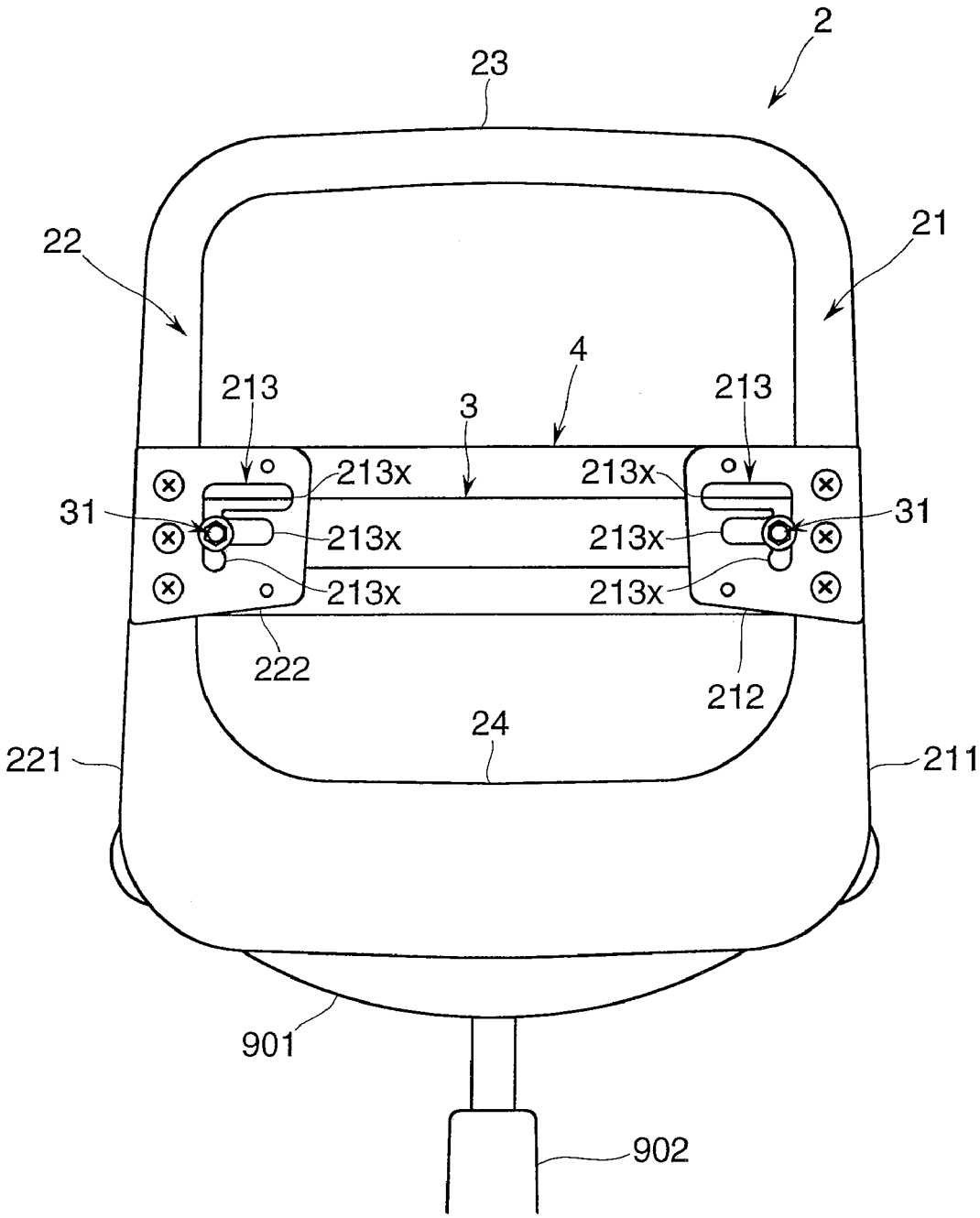
FIG. 11 is a back view of the principal part showing a modified form of the present claimed invention.

First, in the above embodiment there are two engaging edge portions (the inner side edge 214*a* of the long hole portion 214 and the inner side edge 215*a* of the round hole portion 215) with which the pin 31 makes an engagement when the support member 3 receives a load of a seated person, however, three and more engaging edge portions 213*x* may be arranged as shown in a first modified form in FIG. 11. In this case, the bent amount of the support member 3 can be adjusted in three and more levels. In addition, as shown in FIG. 11, the pin 31 may be mounted instead of the rotational axis 32 at the right side end portion of the support member 3 and the adjust mechanism of the similar arrangement may be arranged at the right side in addition to the left side. More specifically, the adjust mechanism may be arranged at both right and left sides of the backrest 1. If the adjust mechanism is arranged at the right and left sides of the backrest 1, a variation of the bent amount that can be set increases due to a combination of fastening portions (engaging portions).

Figure 12:
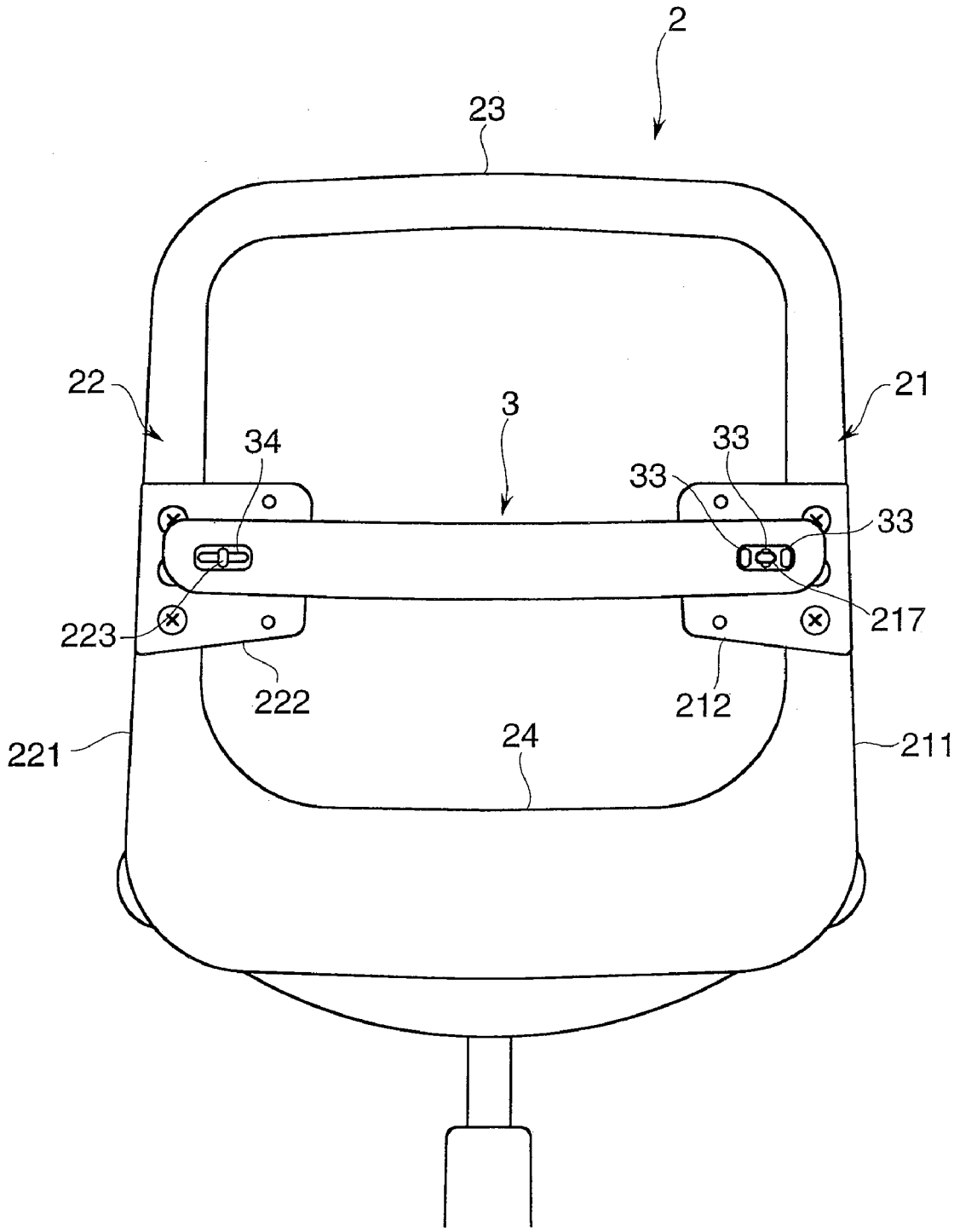
FIG. 12 is a back view of the principal part showing a modified form of the present claimed invention.
Figure 13:
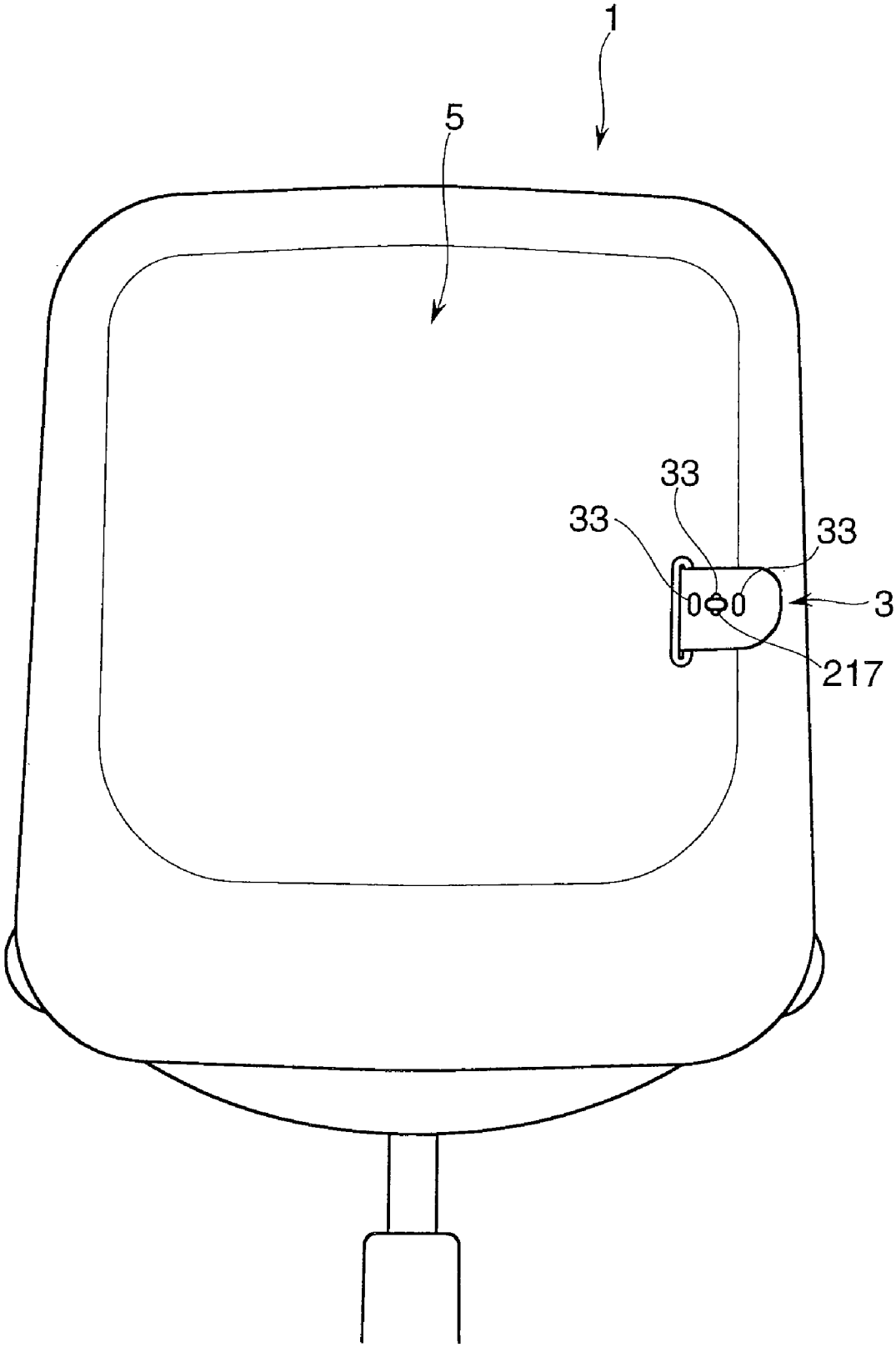
FIG. 13 is a back view of the principal part.

Next, in the above embodiment, the bent amount of the support member 3 is increased or decreased by changing the distance between one end side of the support member 3 and the other end side thereof. More specifically, a length itself of a portion that bends rearward due to the load of the seated person does not change. Contrary, it is possible to increase or decrease the bent amount of the support member 3 by changing a length of a portion that bends rearward due to the load of the seated person. For example, in a second modified form shown in FIG. 12, multiple engaging holes 33 are arranged in one end side (left side in this modified form) of the support member 3 along a width of the support member 3 and a pin 217 that can select and engage one of the multiple engaging holes 33 is arranged on the plate 212 of the frame 21 of the corresponding side (left side) so as to form an engaging structure comprising the engaging hole 33 and the pin 217. A single long hole 34 that extends along the width of the support member 3 is formed in other end side (right side) of the support member 3 and the pin 223 that engages the long hole 34 is arranged on the plate 222 of the same side. When the load of the seated person is applied to the support member 3, a middle portion of the support member 3 bends rearward and the other end side of the support member 3 displaces inward so that an outer side edge of the long hole 34 makes an engagement with the pin 223. Then both sides of the support member 3 are in a state of being tied up by the pins 217, 223 arranged on the plate 212, 222. At this time a portion of the support member 3 between a region tied up by the pin 217 of the plate 212 and a region tied up by the pin 223 of the plate 222 bends rearward. As a result of this, the bent amount of the support member 3 can be increased or decreased by changing the engaging hole 33 that is to engage the pin 217 arranged on the left side plate 212. The upholstery member 5 to which this modified form is applied is preferably so made to open an area of the back face side in order to make it possible to expose the left side end portion of the support member 3 on which multiple engaging holed 33 are formed and the pin 217 of the left side plate 212 that engages one of the engaging holes 33 as shown in FIG. 13. In accordance with the second modified form, it is possible to arrange the backrest 1 for chair comprising frame elements 21, 22 arranged in pairs at right and left sides, a flexible support member 3 that bridges the frame elements 21, 22 to support a load of a body of a seated person and an adjust mechanism that can change a bent degree of the support member 3 in multiple states and that can maintain the state against the load of the seated person and also possible to secure a shape retaining property of a support face S that supports the body of the seated person. In addition, it is possible to keep supporting the body of the seated person at a desired position. The adjust mechanism of the second modified form changes a bent degree of the support member 3 by changing a length of a portion of the support member 3 that transforms to bend due to the load of the seated person. The adjust mechanism is arranged at least one of the right and left side of the support member 3 and selectively fastened one of the multiple different portions of one side of the support member 3 to the frame element 21 locating at the corresponding side. In other words, the adjust mechanism selects one of the engaging holes 33 arranged in multiple at one side of the support member 3 and engages the selected engaging hole 33 with the pin 217 arranged on the plate 212 locating in the frame element 21 of the corresponding side. The left side end portion of the support member 3 where multiple engaging holes 33 are arranged is to be an operating portion to be operated to change the bent degree of the support member 3. The operating portion is exposed from the side portion of the back face of the backrest 1, which makes it possible for the seated person to operate the operating portion to increase or decrease the bent amount of the support member 3 with keeping a seated posture.

Figure 14:
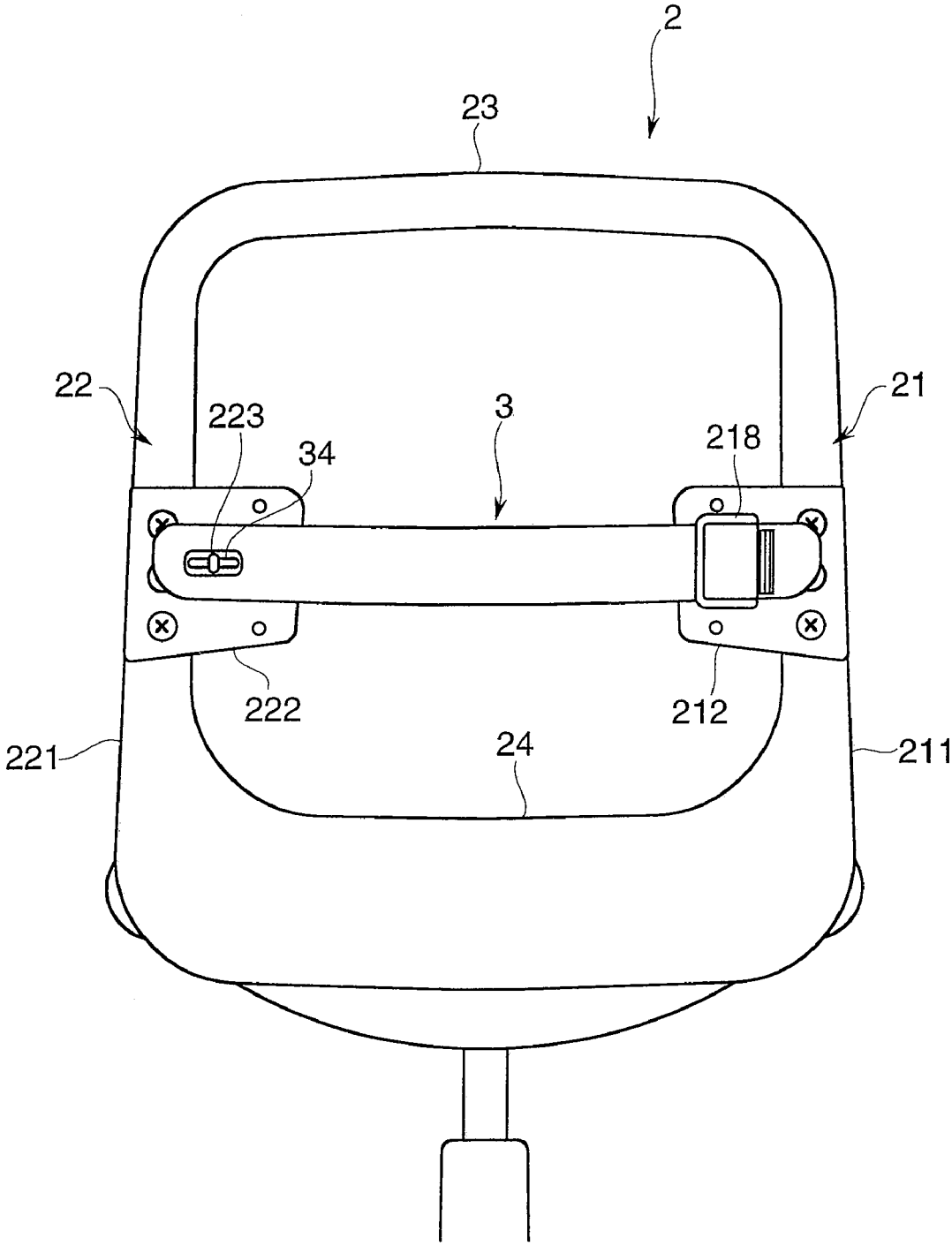
FIG. 14 is a back view of the principal part showing a modified form of the present claimed invention.

In a third modified embodiment shown in FIG. 14, a buckle (a fastener) 218 to fix one end side of the support member 3 to the frame element 21 is arranged instead of the engaging structure comprising the engaging hole 33 and the pin 217. The buckle 218 is so arranged that the support member 3 can be inserted into and ties up the support member 3 at a desired portion in an undetachable manner. An arrangement of the buckle 218 can adopt a well known arrangement such as a buckle for a belt. In this modified form the buckle 218 is mounted on the plate 212 of the left side frame element 21 and a required portion of the left side end portion of the support member 3 can be kept by the use of the buckle 218. The upholstery member 5 to which this modified form is applied is preferable to open a part of an area of a back face side of the upholstery member 5 so as to expose the buckle 218 that keeps the support member 3 and the left side end of the support member 3 like the second modified form shown in FIG. 13. In accordance with the third modified form, it is possible to arrange the backrest 1 for chair comprising frame elements 21, 22 arranged in pairs at right and left sides, a flexible support member 3 that bridges the frame elements 21, 22 to support a load of a body of a seated person and an adjust mechanism that can change a bent degree of the support member 3 in multiple states and that can maintain the state against the load of the seated person and also possible to secure a shape retaining property of a support face S that supports the body of the seated person. In addition, it is possible to keep supporting the body of the seated person at a desired position. The adjust mechanism of the second modified form changes a bent degree of the support member 3 by changing a length of a portion of the support member 3 that transforms to bend due to the load of the seated person. The adjust mechanism is arranged at least one of the right and left side of the support member and selectively fastens one of the multiple different portions of one side of the support member 3 to the frame element 21 locating at the corresponding side. In other words, the adjust mechanism is the buckle 218 that holds the predetermined portion of the one end side of the support member 3 and prevent the support member 3 from moving. The left side end portion of the support member 3 and the buckle 218 are to be an operating portion to be operated to change the bent degree of the support member 3. The operating portion is exposed from the side portion of the back face of the backrest 1, which makes it possible for the seated person to operate the operating portion to increase or decrease the bent amount of the support member 3 with keeping a seated posture.

Figure 15:
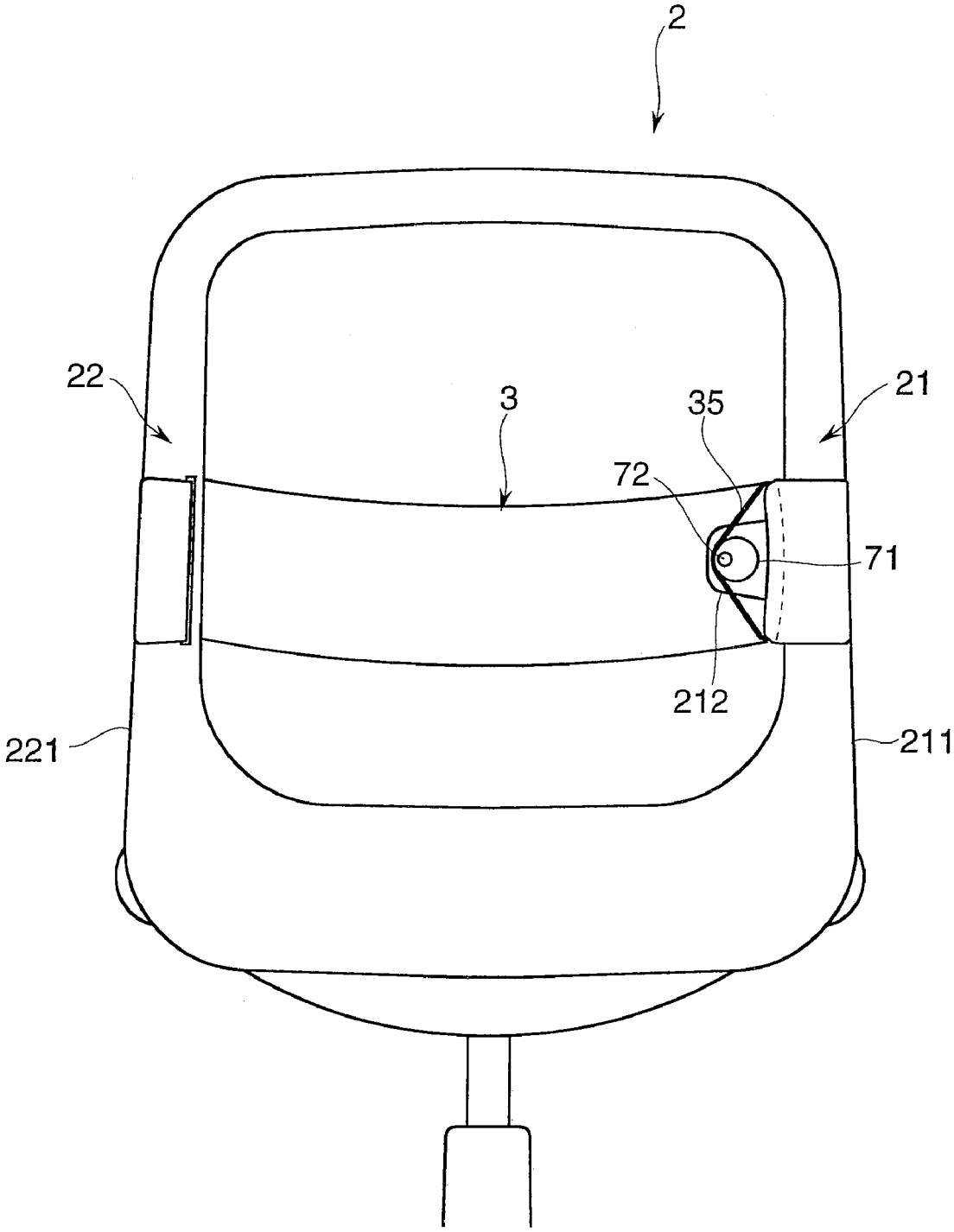
FIG. 15 is a back view of the principal part showing a modified form of the present claimed invention.
Figure 16:
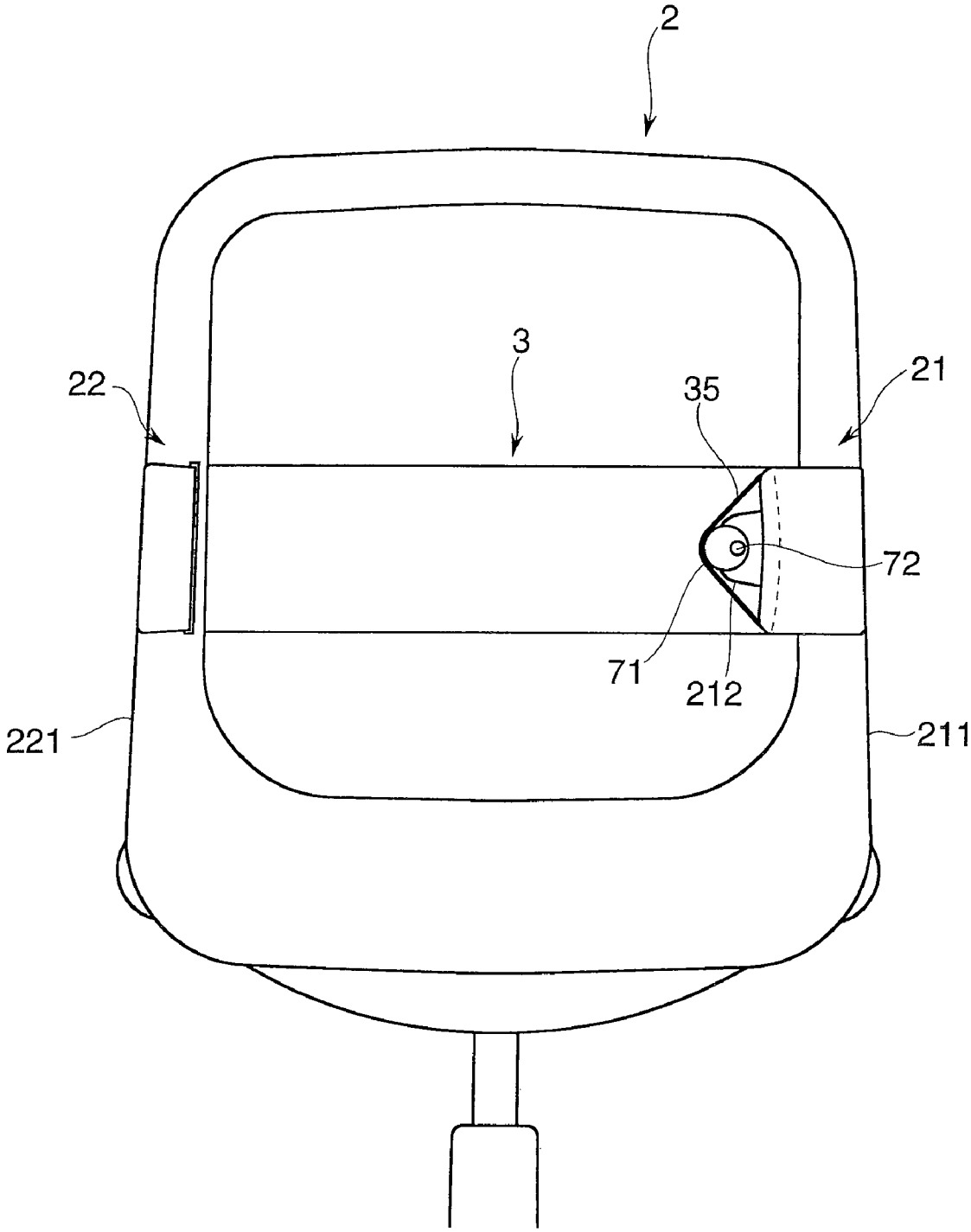
FIG. 16 is a back view of the principal part.

In a fourth modified form shown in FIG. 15 and FIG. 16, one end of the support member 3 winds itself around an outer face of the frame element 21 locating at a corresponding side and positions at a back face side of the backrest 1. At one end portion of the support member 3 arranged is a wire 35 that constitutes an annular portion with both ends of the wire 35 mounted on the support member 3. The other end of the support member 3 is fixed to the frame element 22 locating at the corresponding side. An excentric pulley 71 is mounted in a rotatable manner on a rear face of the plate 212 of the flame element 21 locating at one side through a rotational axis 72 and the wire 35 is wound around the excentric pulley 71. As a result of this, both ends of the support member 3 are supported by the frame elements 21, 22 and a front side portion of the support member 3 that bridges the left side frame 21 and the right side frame 22 bends rearward due to the load of the seated person. A shaft center of the rotational axis 72 is arranged to be excentric from a center of the excentric pulley 71. As a result, a position at which the excentric pulley 71 makes an engagement with the wire 35 changes when the excentric pulley 71 rotates around the rotational axis 72. More specifically, in a state of FIG. 16 wherein the wire 35 is pulled inward relatively widely, more part of the support member 3 is entangled into the back face side of the backrest 1. Then a part of the support member 3 that bridges the front face of the left side frame 211 and the front face of the right side frame 221 becomes relatively short and the bent amount of the support member 3 that transforms to bend due to the load of the seated person also becomes relatively small. Contrary, in a state of FIG. 15 wherein the wire 35 is not pulled inward widely, more part of the support member 3 is entangled into the front face of the backrest 1. Then a part of the support member 3 that bridges the front face of the left side frame 211 and the front face of the right side frame 221 becomes relatively long and the bent amount of the support member 3 that transforms to bend due to the load of the seated person also becomes relatively big. In this modified form, the excentric pulley 71 and the wire 35 that is wound around the excentric pulley 71 constitute the adjust mechanism. The adjust mechanism changes a length of a part of the support member 3 that bridges the front face of the left frame element 21 and the front face of the right frame element 22 by acting on at least one end side of the support member 3 that is wound inward through the frame element 21. In addition, the excentric pulley 71 and an operating member (not shown in drawings) that drives the excentric pulley 71 correspond to an operating portion. It is preferable that the operating portion is exposed to the back face side of the backrest 1 like other modified forms.

Figure 17:
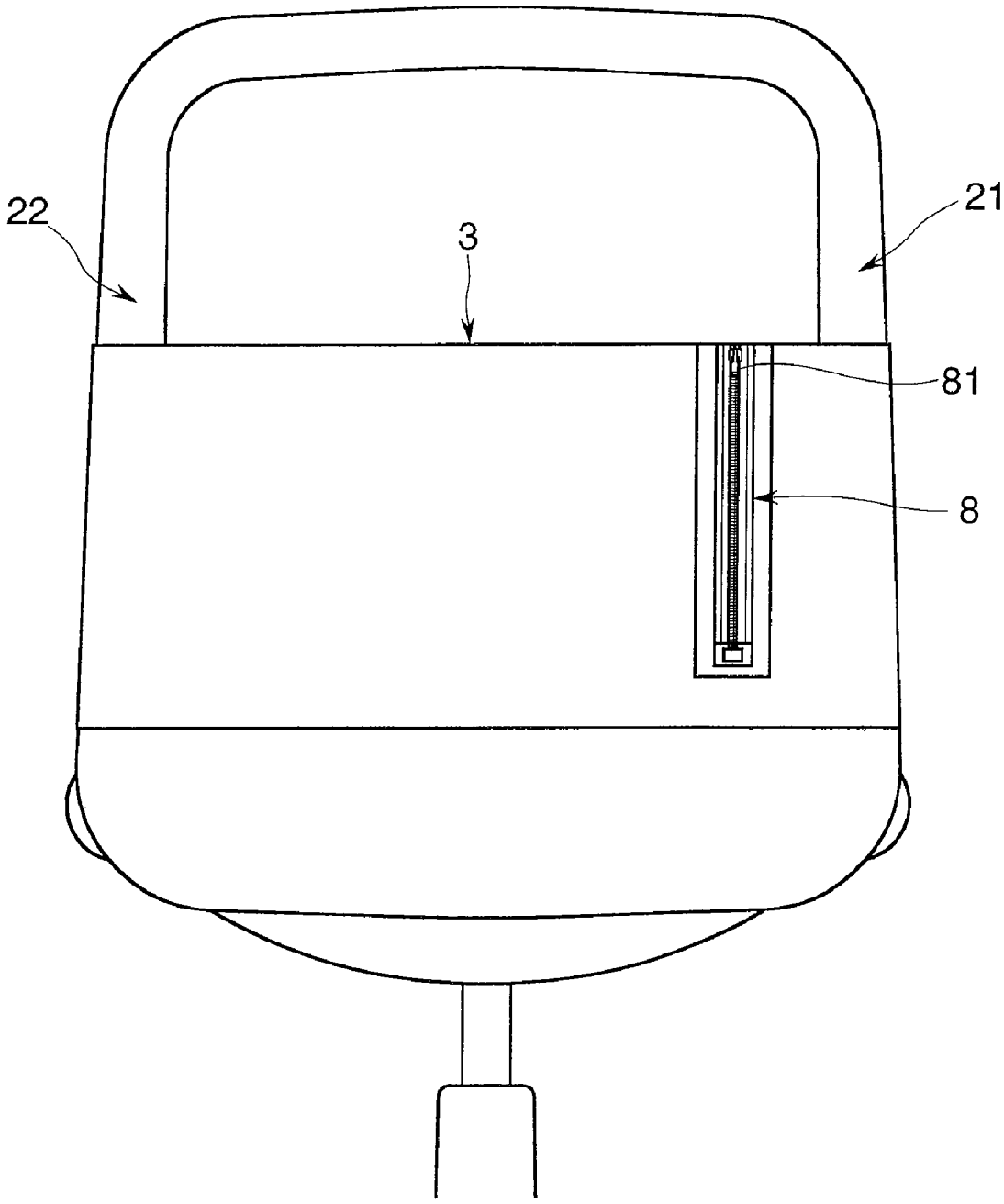
FIG. 17 is a back view of the principal part showing a modified form of the present claimed invention.
Figure 18:
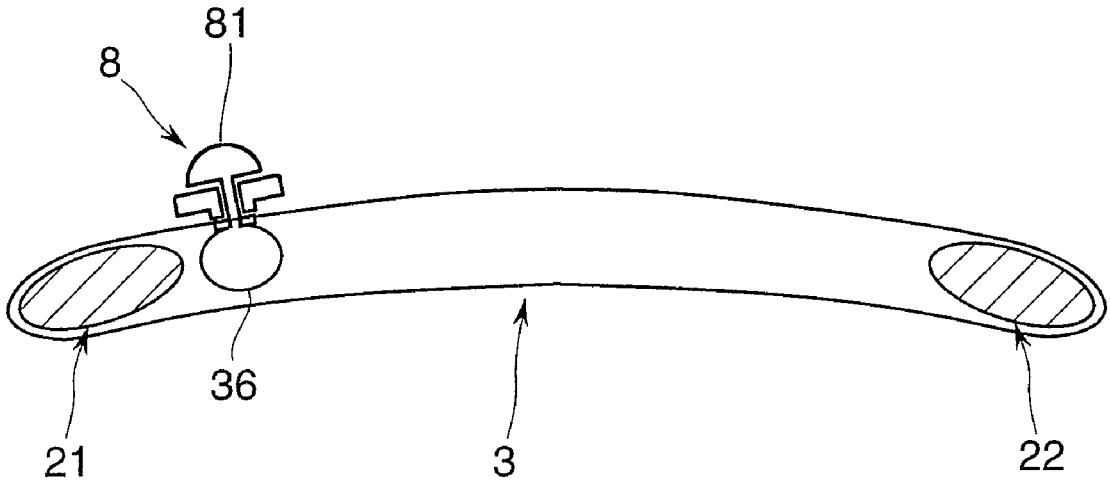
FIG. 18 is a horizontal sectional view of the principal part.
Figure 19:
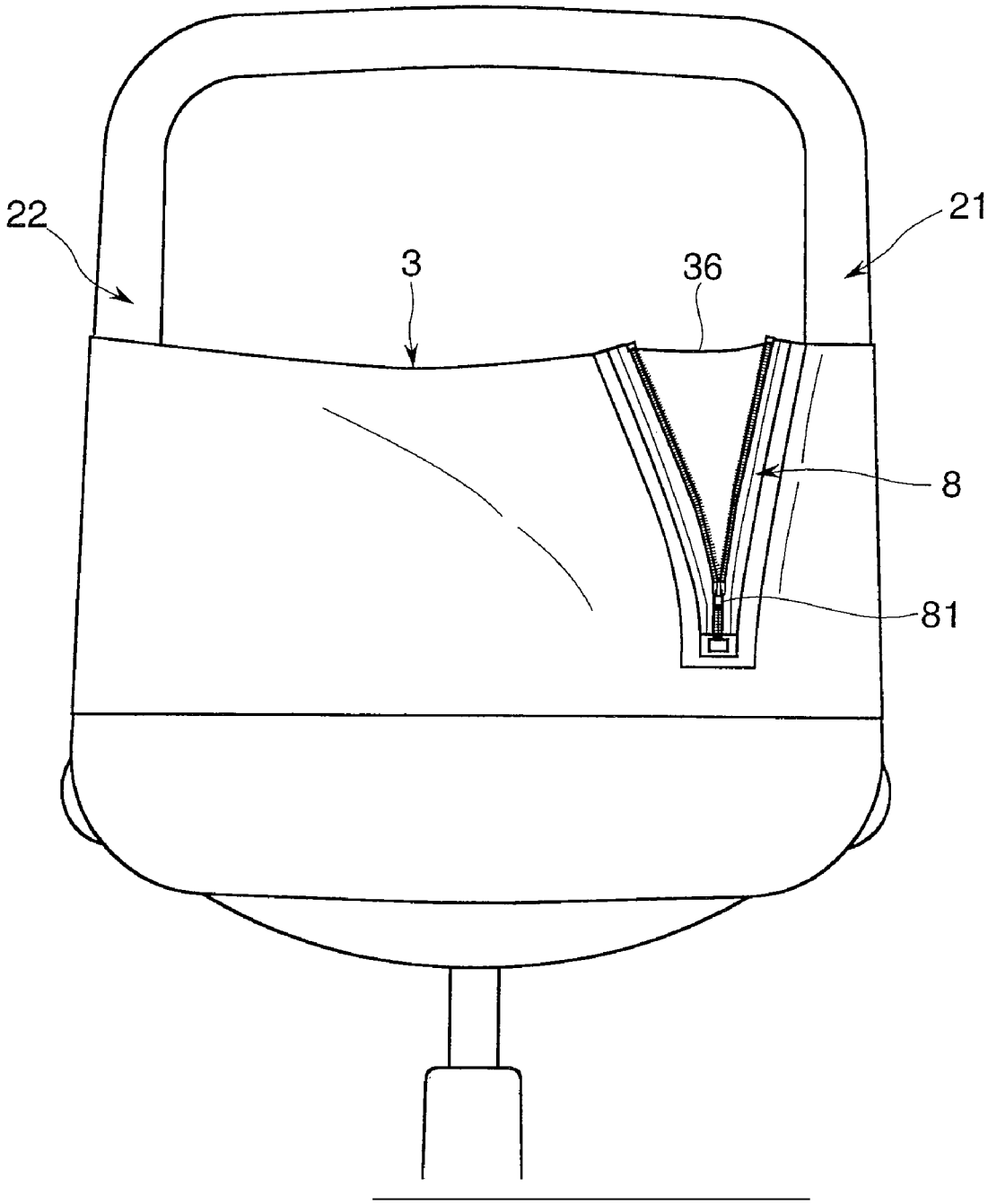
FIG. 19 is a back view of the principal part.
Figure 20:
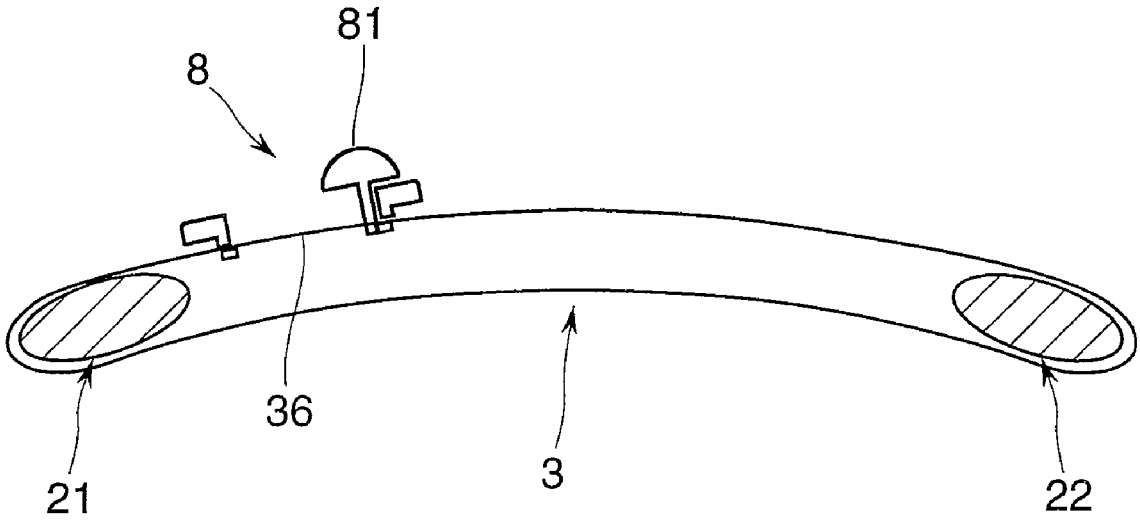
FIG. 20 is a horizontal sectional view of the principal part.

In a fifth modified form shown in FIG. 17 through FIG. 20, the strip-shaped support member 3 is wound around to wrap the frame elements 21, 22 and both end edges of the support member 3 is joined at the back face side of the backrest 1 through a slide fastener 8. The support member 3 is in a tubular shape when the slide fastener 8 is closed. Further, a complementary support member 36 is arranged in an inner face side of the support member 3 to connect one end side of the support member 3 and the other end side thereof. The complementary support member 36 serves as, so to speak, an extending margin that spreads when one end side of the support member 3 and the other end side thereof are separated by opening the slide fastener 8. Like the fourth modified form the front side portion of the support member 3 that bridges the front face of the left side frame 211 and the front face of the right side frame 221 bends rearward due to the load of the seated person. More part of the support member 3 is entangled into the back face side of the backrest 1 in a state that the slide fastener 8 is closed with one end side of the support member 3 and the other end side thereof jointed as shown in FIG. 17 and FIG. 18. As a result, a part of the support member 3 that bridges the front face of the left side frame 211 and the front face of the right side frame 221 becomes relatively short and the bent amount of the support member 3 that transforms to bend due to the load of the seated person also becomes relatively small. Contrary, in a state of FIG. 19 and FIG. 20 wherein the slide fastener 8 is opened, more part of the support member 3 is entangled into the front face of the backrest 1 by separating one end side of the support member 3 from the other end side thereof with the complementary support member 36 spread. Then a part of the support member 3 that bridges the front face of the left side frame 211 and the front face of the right side frame 221 becomes relatively long and the bent amount of the support member 3 that transforms to bend due to the load of the seated person also becomes relatively big. In this modified form the sliding fastener 8 that is arranged at a back face side of the backrest 1 constitutes the adjust mechanism. The adjust mechanism changes a length of a part of the support member 3 that bridges the front face of the left frame element 21 and the front face of the right frame element 22 by acting on both end sides of the support member 3 that is wound inward through the frame elements 21, 22. In addition, a slider 81 of the slide fastener 8 corresponds to an operating portion. It is preferable that the operating portion is exposed to the back face side of the backrest 1 like other modified forms. The support member 3 itself may serve as an upholstery member that constitutes the support face S.

Other concrete arrangement is not limited to the above-described embodiment and may be variously modified without departing from the spirit of the invention.

The invention claimed is:

1. A chair comprising:

a backrest and a seat, the seat including a front and a back and the backrest being attached to the back of the seat and comprising:

a front side and a back side;

a frame including a pair of frame elements extending in a vertical direction and arranged at right and left sides of the backrest, a flexible support member configured to bridge the pair of frame elements and support a load of a body of a person seated against the front side of the backrest, wherein the flexible support member is configured to bend concave rearward so as to wrap around a back and lumbar of the body of the person seated; and an adjustment mechanism including a pin and a plate, the pin being coupled to the flexible support member and including a shaft portion, the plate being coupled to one of the frame elements and including a lone hole portion extending in a direction of the width of the backrest and a round hole portion housed below the long hole portion, wherein the long hole portion and round hole portion are arranged to integrally form a through hole;

wherein the adjustment mechanism is configured to allow variance in the amount of concave rearward bend of the support member as a result of the load of the body of the person seated against the front side of the backrest through movement of the pin relative to the plate from a first state in which the shaft of the pin is engaged with an inner side edge of the round hole portion to a second state in which the shaft of the pin is engaged with an inner side edge of the long hole portion.

2. The chair of claim 1, wherein the flexible support member is arranged at a height generally corresponding to a lumbar of the body of the person seated.

3. The chair of claim 2, further comprising a generally bag-shaped upholstery cover.

4. The chair of claim 1, wherein the adjustment mechanism is positioned and configured such that the person seated against the front side of the backrest can vary the position of the pin from the first state to the second state from the seated position.

5. The chair of claim 1, wherein a first adjustment mechanism includes a first pin and first plate housed on the left vertical side of the frame and wherein a second adjustment mechanism housed on the right vertical side of the frame includes a second pin and a second plate, the first and second pins each being coupled to the support member and including a shaft portion, each of the first and second plate being coupled to the frame and, including a through hole configured to house the first and second pin respectively; and wherein the adjust mechanism is configured to allow variance in the amount of concave rearward bend of the support member as a result of the load of the body of the person seated against the front side of the backrest by permitting movement of at least one of the first and second pins relative to the respective first and second plates.

6. The chair of claim 1, wherein the adjustment mechanism includes a plurality of long hole portions configured to engage the shaft of the pin so as to permit variance in the amount of concave rearward bend of the flexible support member.

7. The chair of claim 6, wherein the plurality of long hole portions are parallel.

8. A chair comprising:

a seat including a front and back; and a backrest including a frame, a support member extending between a left vertical side and a right vertical side of the frame, and an adjustment mechanism configured to permit the support member to extend in a further concave rearward orientation relative to an initial state upon application of a load of a body of a person seated to the support member, the backrest being coupled to the back of the seat, the adjustment mechanism including a plate coupled to one of the left vertical side and the right vertical side of the frame and a pin, the pin being configured to engage the support member at a through hole in the support member by extending through the through hole and engaging a first edge of the through hole;

wherein the adjust mechanism is configured to allow variance in the amount of concave rearward bend of the support member as a result of the load of the body of the person seated against the front side of the backrest by permitting movement of the pin from engagement with a first edge of the through hole to engagement with a second edge of a through hole.

9. The chair of claim 8, wherein the adjust mechanism is further configured to maintain the further concave rearward orientation relative to the initial state after the load of the body of the person seated is removed.

10. The chair of claim 8, wherein the adjust mechanism includes a right side plate coupled to the right vertical side of the frame and a left side plate coupled to the left side plate and wherein the support member is moveably coupled at opposing ends to the right and left side plate.

11. The chair of claim 10, wherein one of the opposing ends of the support member is rotationally coupled to one of the left and right plate such that the support member is configured to rotate about a rotational axis transverse to a rear surface of the one of the left and right plates to which the support member is rotationally coupled.

12. The chair of claim 10, further comprising first and second pins and first and second engaging holes, the first and second pins being attached respectively to the opposing ends of the support member and the first and second through holes being housed on the left side and right side plates respectively, wherein both the first and second through holes are configured to permit the respective first and second pins to engage the first and second through holes at a plurality of engaging positions.

13. The chair of claim 12, wherein the first and second through hole each include a long hole portion extending in a direction of the width of the backrest and a round hole portion housed below the long hole portion, wherein the long hole portion and round hole portion are arranged to integrally form a through hole having an L-shape.

14. The chair of claim 13, wherein the first and second through hole each include a plurality of parallel long hole portions extending in a direction of the width of the backrest and a round hole portion housed below the long hole portions, wherein the long hole portions and round hole portion are arranged to integrally form a through hole having an F-shape.

15. The chair of claim 8, further comprising a shock absorbing member overlapping a front face of the support member.

16. The chair of claim 15, further comprising an upholstery member covering the frame, the support member, adjust mechanism and the shock absorbing member.

17. The chair of claim 8, wherein the adjust mechanism is variable by a person seated in the chair.

18. A chair comprising:

a seat including a front and back;

a backrest including a frame, a support member extending between a left vertical side and a right vertical side of the frame;

a plate coupled to one of the left vertical side and right vertical side;

a pin coupled to one of the support member and the plate and configured to engage a through hole in one of the plate and the support member; and a means for varying an engagement position of the pin from a first state in which the pin engages a first edge of the through hole and a second state in which the pin engages a second edge of a through hole to cause the amount of concave rearward bend of the support member as a result of a load of a body of a person seated against a front side of the backrest to be varied.

19. The chair of claim 18 further comprising, a means for maintaining the varied amount of concave rearward bend of the support member when the load of the body of the person seated against the front side of the backrest is removed.

20. The chair of claim 19, wherein the means for varying an engagement position of the pin from the first state in which the pin engages a first edge of the through hole and a second state in which the pin engages a second edge of a through hole to cause the amount of concave rearward bend of the support member as a result of a load of a body of a person seated against a front side of the backrest to be varied and the means for maintaining the varied amount of concave rearward bend are the same.

* * * * *